United States Patent [19]

Ziebarth et al.

[11] Patent Number: 4,525,959

[45] Date of Patent: Jul. 2, 1985

[54] ABRASIVE FINISHING TOOL

[76] Inventors: Warren S. Ziebarth, 15131 Triton La., 114, Huntington Beach, Calif. 92649; Janet E. Cater, 909 Electric Ave., Seal Beach, Calif. 90740

[21] Appl. No.: 459,918

[22] Filed: Jan. 21, 1983

Related U.S. Application Data

[63] Continuation-in-part of Ser. No. 267,135, May 26, 1981, abandoned.

[51] Int. Cl.[3] ..... B24D 15/02

[52] U.S. Cl. ..... 51/391; 51/372; 51/394; 51/399; 51/380

[58] Field of Search ..... 51/326, 328, 358, 363, 51/372, 380, 381, 391, 399, 394, 397

[56] References Cited

U.S. PATENT DOCUMENTS

| | | | |
|---|---|---|---|
| 2,189,980 | 2/1940 | Forsblade | 51/380 X |
| 2,414,036 | 1/1947 | Gerhan | 51/380 |
| 2,430,785 | 11/1947 | Scattone | 51/380 |
| 2,457,045 | 12/1948 | Kitterman | 51/380 X |
| 2,531,588 | 11/1950 | Stacker | 51/380 |
| 2,626,489 | 1/1953 | Thompson | 51/391 X |
| 3,173,231 | 3/1965 | Moyer | 51/391 |
| 3,339,562 | 9/1967 | Rowe | 51/380 X |
| 3,510,991 | 5/1970 | Bowen | 51/372 |
| 3,564,782 | 2/1971 | Haywood | 51/399 |
| 3,637,359 | 1/1972 | Malloy | 51/399 X |
| 4,242,843 | 1/1981 | Phillips | 51/380 |

*Primary Examiner*—Robert P. Olszewski

*Attorney, Agent, or Firm*—Nilsson, Robbins, Dalgarn, Berliner, Carson & Wurst

[57] ABSTRACT

A hand-held finishing tool includes a forked member with a removable wedge which combine to enable retention of a continuous abrasive belt optionally having two strips with different abrasive grits. Adjoining planar surfaces, angularly related to facilitate finishing operations, form an outer perimeter of the forked member. The interior of the forked member has an undulating U-shaped surface to allow for easy grasping and manipulation of the tool. The rear edge of the two legs of the forked member are spaced apart to facilitate squeezing of the rear of the tool for mounting of the belt. Thereafter, the wedge is insertable to spread about the rear edges of the two legs thereby tightening the belt about the tool periphery.

24 Claims, 7 Drawing Figures

FIG. 1
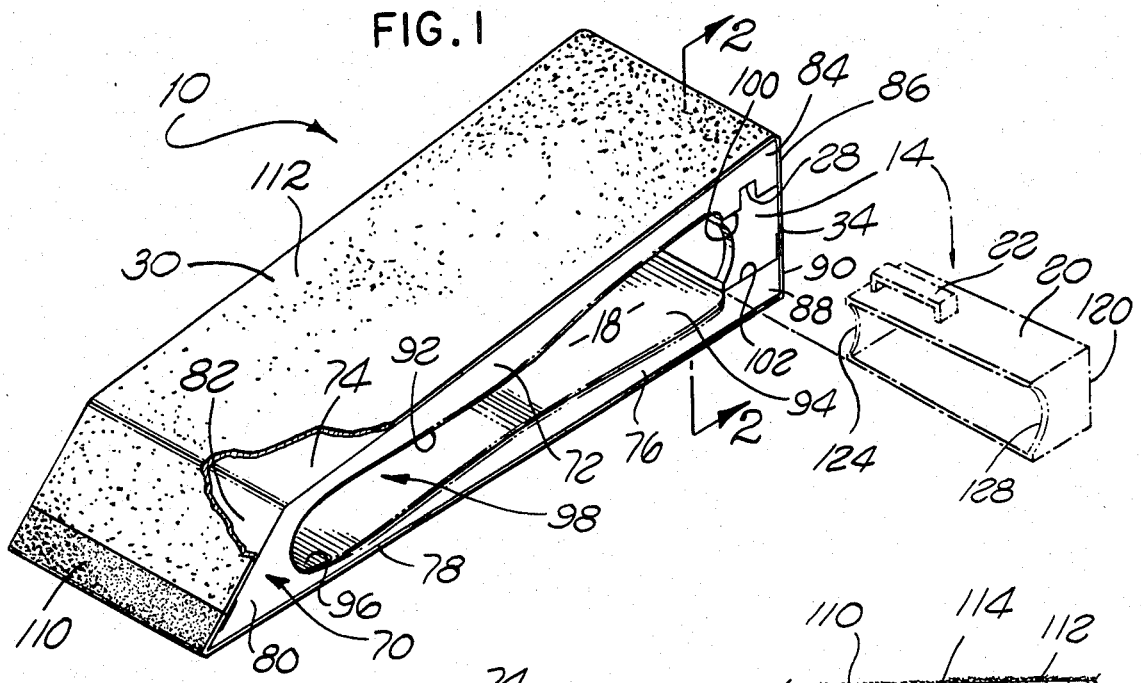
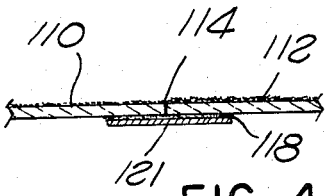
FIG. 4
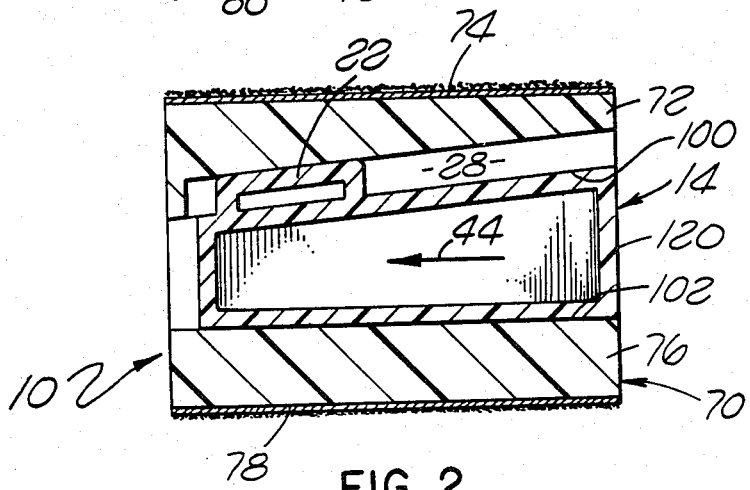
FIG. 2
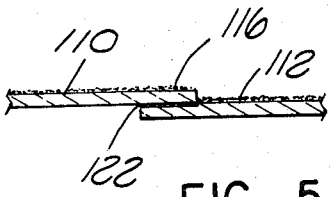
FIG. 5
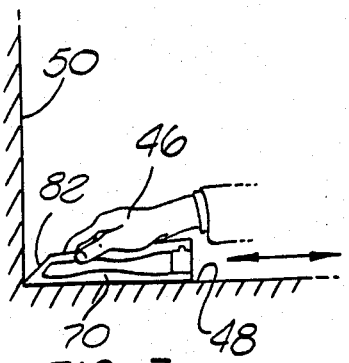
FIG. 3a
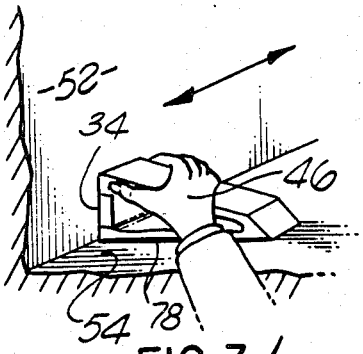
FIG. 3b
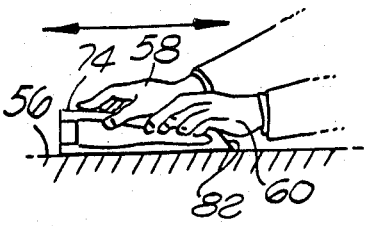
FIG. 3c

ABRASIVE FINISHING TOOL

This is a continuation-in-part of co-pending application Ser. No. 267,135 filed May 26, 1981, now abondoned.

BACKGROUND OF THE INVENTION

The present invention pertains to hand tools and, in particular, to hand-held sanding tools for use with a continuous sanding belt.

A popular device for finishing wooden surfaces is the well-known belt sander. This device features a cloth belt having an outer surface covered with grit forming a conveyor belt-like abrasive surface. The belt is mounted between a pair of rotatable cylindrical members, at least one of which is generally driven by an electric motor. Such a sander is convenient and generally preferred to motor-powered abrasive discs that cannot be directed along the grain of a piece of wood and hence provide unattractive cross-grain cuts in the finished surface.

The rather complex apparatus, including motor, which comprises the belt sander, and the fact that the belt is rotated about cylindrical members, limits its effectiveness for certain detail and close quarters finishing tasks. The cylindrical members lift either end of the belt from the underlying surface in arcs, rendering the ends of the belt without abrasive effect. While the belt sander is very effective in a relatively open area, it does not operate well in close proximity to a surface oriented perpendicular to the surface being finished. For example, when sanding a floor, the belt sander often must be discarded near an adjoining wall and the work completed by hand finishing the edges of the floor.

A piece of sandpaper is commonly employed for hand-finishing these edges. It is often advantageous to mount the sandpaper to a block of wood to create a sanding block having a planar abrasive surface. Nails, tacks and/or glue secure the sheet of sandpaper to the block. The sandpaper, which is generally of inferior quality to the commercial grade cloth abrasive belts commonly employed by conventional belt sanders, is often torn from the sanding block due to the combination of its relatively low strength and localized stresses created in the vicinity of the nails or tacks which fasten the paper to the block. Valuable time is lost when the workman must continually fix a new piece of sandpaper to the block. In addition, the sanding block is generally formed of a solid piece of wood that cannot be easily grasped. Over an extended period of time, working with such a tool may cause cramping of the workman's hands and resultant discomfort.

SUMMARY OF THE INVENTION

The present invention comprises a hand finishing tool for use with a continuous abrasive belt and includes a unitary fork member having a length and a width transverse to the direction of the length. The forked member has a lengthwise first leg with a planar first outside surface and a lengthwise second leg with a planar second outside surface and a junction region between the first and second legs where the junction region has a planar outside connecting surface connecting the first and second outside surfaces. The junction region defines a front end of the finishing tool. The first leg extends rearward from the front of the finishing tool and terminates in a first rear edge having a planar outside first rear edge surface angled from the first outside surface. The second leg similarly extends rearwardly from the front end and terminates in a second rear edge having a planar outside second rear edge surface angled from the second outside rear edge. The forked member further defines an inside surface having a first inside surface region extending from the first rear edge along the first length and a second inside surface region extending from the second rear edge along the second leg in generally facing relationship to the first surface. A U-shaped inside connecting surface extends between the first and second inside surface regions at the front end of the finishing tool. The inside surface therefore abounds an opened sided channel cavity between the first and second legs which extends across the width of the forked member. The first and second legs of the forked member are resiliently flexuous at the location of the junction region to enable alteration of the spacing between the first and second legs along their lengths. The forked member further includes a first slide surface along the first inside surface region adjacent the first rear edge and a second slide surface along a portion of the second inside surface adjacent the second rear edge. The first and second slide surfaces extend widthwise across the forked member and are spaced at in aligned relationship to each other where at least one of the first and second slide surfaces is tapered toward the other in the direction of the forked member width.

A wedge member is then provided to be inserted in the direction of the width of the forked member into the region between the first and second slide surfaces to wedge apart the first and second legs and affect tightening of the abrasive belt on the finishing tool. The cavity between the first and second legs remains accessible after insertion of the wedge member from the sides of the forked member for gripping of the finishing tool.

BRIEF DESCRIPTION OF THE DRAWINGS

FIG. 1 is a perspective view of the present invention with the wedge exploded and shown in phantom view;

FIG. 2 is a sectional view of the abrasive tool of the invention taken along the line 2—2 of FIG. 1 for the purpose of illustrating the interaction of the adjustment wedge with the mounting block of the present invention;

FIG. *3a*, *3b* and *3c* illustrate the use of the present invention to edge a surface, finish a rabbit joint and apply significant pressure to a suriace during finishing, respectively.

FIG. 4 illustrates a butt joint for a dual grit continuous abrasive belt;

FIG. 5 illustrates a lap joint for a dual grit continuous abrasive belt.

DETAILED DESCRIPTION

FIG. 1 is a perspective view of the finishing tool 10 of the invention. The invention generally comprises a forked member 70 joined with admustment wedge 14. The forked member 70 is of an easy-to-grasp design having a hollow interior cavity 98 bounded by an undulating inside surface 18.

The finishing tool in accordance with the invention includes a unitary forked member 70 having a first leg 72 with a first planar outside surface 74 and a second leg 76 with a planar second outside surface 78. A junction region 80 extends between the first and second legs 72 and 76 with the junction region 80 defining an outside connecting surface 82 which connects the first and second outside surfaces 74 and 78, respectively. The region of the finishing tool at the junction region 80 comprises the front end of the finishing tool.

The first leg 72 terminates at a first rear edge region 84 having a planar outside first rear edge surface 86 which is angled downwardly at an angle slightly less than 90° to the first outside surface 74. The second leg 76 terminates at a second rear edge region 88 having a planar outside second rear edge surface 90 which is angled upwardly from the second outside surface 78 preferably at an angle of 90°. The dimension between the rear edge surfaces 86 and 90 and the front end of the forked member 70 defines the length dimension of the finishing tool about which an abrasive belt 30 is positioned.

The forked member 70 further has an inside surface 18 having a first inside surface region 92 extending from the first rear edge 84 along the first leg 72 and a second inside surface 94 extending from the second rear edge 88 along the inside of the second leg 76 in generally facing relationship to the first inside surface 92. The inside surface 18 further includes a U-shaped inside connecting surface 96 between the first and second inside surface regions 92 and 94 respectively. The inside surface 18 defines and bounds an open sided channel cavity 98 between the first and second legs 72 and 76 which extends across the width of the forked member 70.

In accordance with the invention, the first and second legs 72 and 76 are resiliently flexuous along their lengths starting generally at the location just rearward of the junction region 80 to allow the rear edges 84 and 88 of the legs 72 and 76 respectively to be squeezed together to alter the spacing between the first and second legs 72 and 76 along their lengths to facilitate mounting of the abrasive belt 30 about the lengthwise periphery of the tool 10.

Referring to FIG. 2 in conjunction with FIG. 1, the first inside surface region 92 has a first slide surface 100 at the first rear edge region 84 and the second inside surface region 94 as a second slide surface 102 at the second rear edge region 88. The first and second slide surfaces 100 and 102 extend across the width of the forked member 70 in spaced apart facing but aligned relationship to each other. At least one of the first and second slide surfaces 100 and 102 is tapered toward the other across the width of the forked member 70.

In accordance with the invention, a wedge member 14 is provided to be inserted from the side of the forked member 70 and slid into the space between the first and second slide surfaces 100 and 102 to force the first leg 72 and the second leg 76 apart so as to affect tightening of the abrasive belt 30 which is mounted around the periphery of the finishing tool 10. In such an embodiment, the cavity 98 remains accessible to the hands of the user from the sides of the tool as illustrated in FIGS. 3*a* through 3*c*.

Referring again to FIG. 1, the first inside surface region 92 and the second inside surface region 94 are undulating surfaces along their respective lengths. As such, the thickness of the first leg and the second leg 72 and 76 respectively vary along their lengths. The increased thickness permitted by the undulation of the surface 18 provides a thickened and hence strengthened center region of each leg 72 and 76 to aid in maintaining the flatness of the planar surfaces 74 and 78 and prevent warping when pressure is applied to those surfaces during the sanding process. In addition, the region of thinness near the front of the forked member 70 facilitates the squeezing together of the rear edge regions 84 and 88 when the wedge member 14 is not in place, thereby allowing the abrasive belt to be more easily slipped over the finishing tool. Thereafter, the legs 72 and 76 upon being released return to their original unsqueezed condition enabling the wedge member 14 to be inserted to wedge the two legs apart and thereby tighten the belt 30 about the periphery of the finishing tool 10.

In addition, the undulation of the surfaces 92 and 94 provides a more convenient and easily grasped inside surface by one or both hands. For example, the fingers of one hand can extend into the cavity from the side of the finishing tool adjacent the front narrowed region of the legs and the fingers of the second hand can extend into the cavity 98 adjacent the rearmost narrowed portion of the legs.

The adjustment wedge 14 is seen in phantom view in FIG. 1 to include an inclined upper surface 20 having a key 22 extending therefrom. The wedge 14 is fitted to the otherwise open rear portion of the mounting block 12 between the second slide surface 102 which in the illustrated embodiment is flat and the first slide surface 100 which has an incline (FIG. 2) and a groove or keyway 28. The wedge member 14 will be seen in FIG. 2 to be slidably positionable with respect to the width of the forked member 70 to adjust the spacing between the lower leg 76 and the upper leg 72 to alter the height of the rear end of the forked member 70.

The adjustment wedge 14 is interiorly hollowed to enable a user to insert a finger into the hollow and pull the wedge to either insert or remove it from the forked member 70. The edges 124 and 128 around which the fingers of the user extend during such insertion or removal are curved to conform to the finger contour thereby providing increased user comfort during such insertion or removal. The wedge 14 and the forked member 70 are made of lightweight, durable and rigid material, preferably plastic such as a composition including fiberglass reinforced high impact polystyrene and structural foam. Such a material enables the design of a forked member 70 to have minimal weight. In addition, such material experiences little or no shrinkage when injection molded thereby allowing the surface to be molded in the desired planar configuration with little additional surface flattening, such as by sanding required. It will be appreciated that the planar surfaces 74, 78 and 82 are molded and flattened if necessary to within a tolerance of 0.006 inch of flatteners across the surface in question.

The belt 30 has an abrasive outer surface and surrounds the finishing took 10. The belt 30 is maintained taut and in intimate contact with the perimeter formed of its planar adjoining outer surfaces 82 (front surface), 74 (top surface), 34 (rear surface) and 78 (bottom surface) by means of the adjustability of the height of the rear edges 84 and 88 of the legs 72 and 76. The belt 30 is of the type utilized by a conventional belt sander. Generally, such a belt is of relatively high quality construction and long lasting, utilizing a durable cloth backing for its abrasive grit-like surface.

The belt may be a continuous belt with a single abrasive courseness or may, as illustrated in FIGS. 1, 4 and 5, comprise a belt made of two sections 110 and 112 of substantially the same length each having a different grit courseness. The two sections may be joined together with suitable conventional adhesive using a part of butt joints 114 as illustrated in FIG. 4 or adhesively attached together using a pair of lap joints 116 such as shown in FIG. 5. In accordance with the embodiment illustrated in FIG. 4, a butt joint may be made by simply butting one end of the section 112 against one end of the section 110, applying a suitable adhesive 118 to the surface of the respective belt opposite the grit surface and then joining the two ends together utilizing a suitable nylon strip 121 which is held to each of the respective belt sections by the adhesive 118. The other ends of the respective belts 110 and 112 are similarly joined to form the continuous belt 30.

In FIG. 5, a lap joint is illustrated wherein a suitable adhesive 122 is placed on the bottom of one belt section 110 and on the top of the other belt section 112 along their respective ends with the respective ends overlapped and adhesively held together with adhesive 122.

The finishing tool 10 is dimensioned to receive a standard commercial sized belt 30. For example, in a preferred embodiment of the invention, the finishing tool for use with a standard belt size of 7.5 centimeters (width) by 53 centimeters (circumference) has the following dimensions with respect to the planar outer surfaces: 7.5 centimeters by 19.7 centimeters (top surface 74); 7.5 centimeters by 5.1 centimeters (front surface 82); 7.5 centimeters by 23 centimeters (lower surface 78); and 7.5 centimeters by 4.7 centimeters (rear surface 34).

For comfort in using the tool in accordance with the invention, it is preferred that the top surface 74 have an incline relative to the bottom surface 78 less than about 10°.

The front surface 82 is inclined at an angle of approximately 45 degrees with respect to the lower surface 78. In the discussion of FIGS. *3a*, *3b* and *3c* to follow, it will be seen that the angular relationship of the front surface 82 to the lower surface 78 is of particular utility with respect to sanding the edge of a surface adjacent a wall or the like. The rear surface 34 is perpendicular to the lower surface 78 for advantageous use in the finishing or "truing" of the mutually perpendicular elements of a rabbit joint or the like.

FIG. 2 is a sectional view of the tool 10 taken along the line 2—2 of FIG. 1. This figure illustrates the manner in which the adjustment wedge 14 is fitted to the otherwise open rear portion of the forked member 70 between the lower slide surface 102 and the upper slide surface 100. From the discussion to follow, it will be seen that the wedge 14 may be slidably positioned within the channel formed between the two slide surfaces 100 and 102 to vary the height of the rear surface 34 and thereby adjust the outer perimeter of the sanding block for slight irregularities in the circumferences of sized sanding belts.

The hollow wedge 14, including the key 22 integrally formed with the inclined upper surface 20, fits into the space bordered by the lower surface 102 and the inclined upper surface 100, respectively. The length of the wedge 14 is somewhat less than the width of the finishing tool 10 to allow the wedge to be fitted in a range of positions within the channel without extending beyond a side of the forked member 70. The surface 100, the top of the key 22, and the wedge surface 20 are identically inclined to form both a channel and a wedge of narrowing height from right to left as seen in FIG. 2.

In operation, the forked member 70 is first squeezed to push the legs 72 and 74 together. The abrasive belt 30 is then fitted loosely about the tool 10 and the legs 72 and 74 released from their squeezed condition whereupon the legs resiliently return to their pre-squeezed position. The wedge 14 is then inserted into the rear of the block 70 and advanced in the direction indicated by the arrow 44. As the wedge 14 is advanced along this direction, the interacting of the inclined top surface of the key 22 and the inclined top surface 20 of the wedge 14 with the narrowing channel formed between the surfaces 100 and 102 cause the height of the channel 98 between the surfaces 100 and 102 to expand. The expansion of the height of the channel 98 and the consequent increase in the height of the rear surface 34 and of the perimeter length of the tool 10 will proceed until the perimeter has reached the maximum expansion possible within the confines of the circumference of the belt 30. At such time, the wedge 14 is fitted tightly between the legs 72 and 76 and the belt 30 is taut and in intimate relation to the tool perimeter.

In accordance with another aspect of the invention, the wedge 14 also includes a flat rear surface 120 which is aligned relative to the key 22 and the groove 28 so that when the wedge 14 is inserted into the channel between the surfaces 100 and 102 with the key 22 in the channel 28, the rear surface 120 will align with the surfaces 86 and 90 to form a continuous planar back surface 34.

By a reversal of the above-referenced process, the tension may be reduced within the belt 30 and the user may then remove or rotate the belt upon the tool 10 to redistribute the abrasive belt 30 with respect to the surface of the block 10 exchanging worn portions of the belt with its less worn portions. Thus, the effective life of the abrasive surface of the sanding belt 30 is enhanced. Further utility is realized by the fact that present invention which may effectively employ as its abrasive surface a sanding belt that no longer functions well at the normal operative speed of a belt sander.

FIGS. *3a*, *3b* and *3c* illustrate various advantageous uses of the tool of the present invention. In FIG. *3a* one can see that the undulating surfaces in conjunction with the cavity 98 provides a comfortable geometry for one to grasp with one or two hands 46. The relatively broad width of the tool, combined with its hollow interior 98, allows the craftsman to grasp the tool in a manner which extends, rather than cramps, the positions of his fingers to minimize fatigue that often results from the use of a conventional sanding block over an extended period of time. In addition, the hollow cavity enables the user to grasp the tool in a way that keeps the user's hands away from the work surface thereby reducing the possibility of injury. Finally, the hollow design allows a user to clamp the tool to a work bench and move a work piece over the abrasive surface which remains stationary.

In FIG. *3a*, one can clearly see that the incline of the front surface 82 of the sanding block 10 allows the craftsman to finish a floor or other surface 48 up to the edge or boundary defined by a perpendicular surface such as a wall 50. The craftsman may use a belt sander, having a similar or even the same abrasive belt 30, on the hand tool of the invention to finish the more accessible central portions of the surface 48 prior to or after finishing the corners as shown in FIG. *3a*. The angular incline of the front surface 82 assures that, in finishing the surface 48 to the corner where it and the perpendicular surface 50 are joined, undesired finishing or scratching of the surface or wall 50 does not occur. The inclined surface 82 also allows the user an improved view of the wall 50 near the junction with the work surface 48. This is to be contrasted with the situation shown in FIG. 3*b* wherein the vertical rear surface 34 of the tool 10 is utilized in combination with the lower surface 78 perpendicular thereto to "true up" a right angle or rabbit joint formed at the intersection of the surfaces 52 and 54. Although the user has grasped the tool in a reversed position, its broad upper surface 74 combined with the hollow interior 98 still offers a comfortable geometry for grasping the tool.

Finally, in FIG. 3*c*, there is illustrated a further orientation of the sanding block which enables the user to apply maximum abrasive force to a surface 56. To achieve maximum finishing force, the user exterts downward pressure with his hands 58 and 60 upon the inclined upper surface 74 and the inclined front surface 82 of the tool, respectively, as shown. Even while exerting substantial force, the relatively large planar surfaces of the tool afford comfort to the user. In all of the instances illustrated in FIGS. 3*a*, 3*b* and 3c, it is additionally helpful to the craftsman that the palm of his hand contacts a somewhat rough surface, the grit of the abrasive belt 30, to limit slippage that might occur if the surface were absolutely smooth.

Thus it is seen that there has been brought to the hand crafting and finishing tool arts a new and improved tool for performing various essential tasks in finishing a surface or the like. Utilizing apparatus according to the present invention, one may obtain the advantages of high quality abrasive belts manufactured in conventional sizes for an electric belt sander or the like without the aforementioned disadvantages often encountered in standard finishing tasks.

What is claimed is:

1. A hand finishing tool for use with a continuous abrasive belt comprising:

a unitary forked member having a length and a width in a transverse direction to the length and having a lengthwise first leg with a planar first outside surface, a lengthwise second leg with a planar second outside surface and a connecting surface connecting the first and second outside surfaces to define a wedge shaped front end with a knife-like transverse edge at the junction between the connecting surface and the second outside surface, the first leg terminating at a first rear edge region having a planar outside first rear edge surface angled from the first outside surface, the second leg terminating at a second rear edge region having a planar outside second rear edge surface angled from the second outside surface, the first and second rear edge surfaces being remote from the front end of the finishing tool, the forked member further having an inside surface defining a first inside surface region extending from the first rear edge region along the first leg, a second inside surface extending from the second rear edge region along the second leg in generally facing relationship to the first inside surface, and a U-shaped inside connecting surface region between the first and second inside surface regions adjacent the front end of the finishing tool, the inside surface bounding an open sided channel cavity extending across the width of the forked member, the first and second legs of the forked member between the first and second legs, being resiliently flexuous to alter the spacing between the first and second legs along their lengths, the first inside surface region having a first slide surface at the first rear edge region and the second inside surface region having a second slide surface at the second rear edge region, the first and second slide surfaces extending across the width of the forked member in spaced apart, aligned relationship to each other, at least one of the first and second slide surfaces tapering toward the other of the first and second slide surfaces in the direction of the forked member width the belt being insertable around the unitary forked member along the direction of the length thereof; and a wedge member for being inserted in the direction of the width of the forked member into the region between the first and second slide surface to wedge apart the first and second legs and effect tightening of the abrasive belt on the finishing tool, the cavity between the first and second legs remaining accessible from the sides of the forked member for gripping the finishing tool.

2. The hand finishing tool of claim 1 wherein the forked member comprises fiberglass reinforced high impact polystyrene.

3. The finishing tool of claim 1 wherein the first inside surface region and the second inside surface region each comprise undulating surfaces along their respective lengths whereby the thickness of the first and second legs is greatest at a central region between the front end and the respective first and second rear edge regions.

4. The finishing tool of claim 1 wherein the wedge member has a planar rear surface, the finishing tool further comprising alignment means for aligning the wedge member with the forked member when the wedge member is inserted between the first and second slide surfaces whereby the planar rear surface of the wedge member is held in planar alignment with the first and second rear edge surfaces to form a continuous planar rear edge surface connecting the first and second rear edge surfaces to define a continuous perimeter around the finishing tool.

5. The finishing tool of claim 3 wherein the wedge member has a planar rear surface, the finishing tool further comprising alignment means for aligning the wedge member with the forked member when the wedge member is inserted between the first and second slide surfaces whereby the planar rear surface of the wedge member is held in planar alignment with the first and second rear edge surfaces to form a continuous rear edge surface connecting the first and second rear edge surface to define a continuous perimeter around the finishing tool.

6. The finishing tool of claim 4 wherein at least one of the first and second slide surfaces has a groove therein extending in the direction of the width of the forked member, the alignment means comprising a key extending from the wedge member for being inserted into and guided by the groove.

7. The finishing tool of claim 5 wherein at least one of the first and second slide surfaces has a groove therein extending in the direction of the width of the forked member, the alignment means comprising a key extending from the wedge member for being inserted into and guided by the groove.

8. The finishing tool of claim 1 wherein the first and second outside surface and the connecting surface are planar within a tolerance of 0.006 inches.

9. The finishing tool of claim 1 wherein the first and second outside surfaces and the connecting surface are rigid, hard surfaces for maintaining their planar shape during use.

10. The finishing tool of claim 1 wherein the wedge member comprises a hollow block opened on one side, the open side being positioned to face into the cavity whereby the wedge member can be grasped in the cavity for insertion into and removed from between the first and second slide surfaces.

11. The finishing tool of claim 4 wherein the wedge member comprises a hollow block opened on one side, the open side being positioned to face into the cavity whereby the wedge member can be grasped in the cavity for insertion into and removed from between the first and second slide surfaces.

12. A hand finishing tool comprising:

a unitary forked member having a length and a width in a transverse direction to the length and having a lengthwise first leg with a planar first outside surface, a lengthwise second leg with a planar second outside surface and a junction region between the first and second legs with a planar outside connecting surface connecting the first and second outside surfaces to define a front end of the finishing tool, the first leg terminating at a first rear edge region having a planar outside first rear edge surface angled from the first outside surface, the second leg terminating at a second rear edge region having a planar outside second rear edge surface angled from the second outside surface, the first and second rear edge surfaces being remote from the front end of the finishing tool, the forked member further having an inside surface defining a first inside surface region extending from the first rear edge region along the first leg, a second inside surface region extending from the second rear edge region along the second leg in generally facing relationship to the first inside surface, and a U-shaped inside connecting surface region between the first and second inside surface regions adjacent the front end of the finishing tool, the inside surface bounding an open sided channel cavity extending across the width of the forked member between the first and second legs, the first and second legs of the forked member being resiliently flexuous to alter the spacing between the first and second legs along their lengths, the first inside surface region having a first slide surface at the first rear edge region and the second inside surface region having a second slide surface at the second rear edge region, the first and second slide surfaces tapering toward the other of the first and second slide surfaces in the direction of the forked member width;

a wedge member for being inserted in the direction of the width of the forked member into the region between the first and second slide surface to wedge apart the first and second legs whereby the cavity between the first and second legs remains accessible to enabling gripping of the finishing tool; and a continuous abrasive belt positioned to extend around the forked member in the direction of the length thereof whereby tightening of the belt on the forked member is effected by insertion of the wedge member between the first and second slide surfaces.

13. The hand finishing tool of claim 12 wherein the forked member comprises fiberglass reinforced high impact polystyrene.

14. The finishing tool of claim 12 wherein the first inside surface region and the second inside surface region each comprise undulating surfaces along their respective lengths whereby the thickness of the first and second legs is greatest at a central region between the front end and the respective first and second rear edge regions.

15. The finishing tool of claim 12 wherein the wedge member has a planar rear surface, the finishing tool further comprising alignment means for aligning the wedge member with the forked member when the wedge member is inserted between the first and second slide surfaces whereby the planar rear surface of the wedge member is held in planar alignment with the first and second rear edge surfaces to form a continuous planar rear edge surface connecting the first and second rear edge surfaces to define a continuous perimeter around the finishing tool.

16. The finishing tool of claim 12 wherein the wedge member has a planar rear surface, the finishing tool further comprising alignment means for aligning the wedge member with the forked member when the wedge member is inserted between the first and second slide surfaces whereby the planar rear surface of the wedge member is held in planar alignment with the first and second rear edge surfaces to form a continuous rear edge surface connecting the first and second rear edge surface to define a continuous perimeter around the finishing tool.

17. The finishing tool of claim 12 wherein at least one of the first and second slide surfaces has a groove therein extending in the direction of the width of the forked member, the alignment means comprising a key extending from the wedge member for being inserted into and guided by the groove.

18. The finishing tool of claim 12 wherein at least one of the first and second slide surfaces has a groove therein extending in the direction of the width of the forked member, the alignment means comprising a key extending from the wedge member for being inserted into and guided by the groove.

19. The finishing tool of claim 12 wherein the first and second outside surface and the connecting surface are planar within a tolerance of 0.006 inches.

20. The finishing tool of claim 12 wherein the first and second outside surfaces and the connecting surface are rigid, hard surfaces for maintaining their planar shape during use.

21. The finishing tool of claim 12 wherein the wedge member comprises a hollow block opened on one side, the open side being positioned to face into the cavity whereby the wedge member can be grasped in the cavity for insertion into and removed from between the first and second slide surfaces.

22. The finishing tool of claim 12 wherein the wedge member comprises a hollow block opened on one side, the open side being positioned to face into the cavity whereby the wedge member can be grasped in the cavity for insertion into and removed from between the first and second slide surfaces.

23. The finishing tool of claim 12 wherein the continuous abrasive belt comprises:

a first section with a first abrasive coarseness and a second section with a second abrasive coarseness, the length of the first section being substantially the same as the length of the second section.

24. The finishing tool of claim 23 wherein the first section comprises a first strip having a first end and a second end, and the second section comprises a second strip having a first end and a second end, wherein the two first ends and the two second ends are respectively joined to form a first joint and a second joint respectively to form the continuous abrasive belt.

* * * * *